United States Patent [19]

Fuchs

[11] 4,282,950

[45] Aug. 11, 1981

[54] MUFFLER

[76] Inventor: Peter Fuchs, Grenzstrasse 8, Köflach-Pichling, Austria, A-8581

[21] Appl. No.: 72,942

[22] Filed: Sep. 6, 1979

[51] Int. Cl.[3] ..... F01N 1/10

[52] U.S. Cl. ..... 181/257; 181/265; 181/275

[58] Field of Search ..... 181/247, 252, 255–256, 181/264–266, 268–270, 273, 275

[56] References Cited

U.S. PATENT DOCUMENTS 1,844,105 2/1932 Schnell ..... 181/252

FOREIGN PATENT DOCUMENTS 729253 7/1932 France ..... 181/265

1441401 5/1966 France ..... 181/255

565256 7/1957 Italy ..... 181/265

*Primary Examiner*—L. T. Hix

*Assistant Examiner*—Thomas H. Tarcza

*Attorney, Agent, or Firm*—Townsend and Townsend

[57] ABSTRACT

The invention refers to a silencer or muffler for internal combustion engines, particularly for two-stroke or cycle internal combustion engines, comprising at its inlet an essentially frustoconical diffusor, a shell of a truncated cone immediately adjoining with its end having the greater diameter the end of the diffusor having the greater diameter, and deflector for the gas stream downstream of said shell of a truncated cone.

19 Claims, 2 Drawing Figures

MUFFLER

The invention refers to a silencer or muffler for internal combustion engines, particularly for two-stroke or cycle internal combustion engines, comprising at its inlet an essentially frustoconical diffusor, a shell of a truncated cone immediately adjoining with its end having the greater diameter the end of the diffusor having the greater diameter, and deflecting means for the gas stream down-stream of said shell of a truncated cone.

There are already known mufflers for internal combustion engines in which the exhaust gases are first passed through a diffusor and in which subsequent to the diffusor insert components are provided within the muffler housing, said insert components being formed of reflecting elements having, for example, the shape of perforated reflecting plates, roof-like guide surfaces, choke appertures, frustoconical and perforated hollow bodies having one end closed and/or deflecting means for the gas stream. These known mufflers suffer, however, from substantial drawbacks. For instance, manufacture of the insert components and arranging same within the muffler housing requires a substantial time expenditure, so that the production costs for such known mufflers are very high. Above all, the known mufflers are not suitable to attenuate the particularly disturbing high frequencies generated above all when operating two-stroke internal combustion engines.

In known mufflers of an other type, a throttle filter is adjoining the diffusor provided at the muffler inlet. Also with such known mufflers the disturbing noise particularly generated when operating two-stroke internal combustion engines can not be sufficiently attenuated.

It is an object of the present invention to provide a muffler for internal combustion engines which is simple in construction, inexpensive in production and is suitable to give the desired attenuation even of high frequencies. The invention has as a base a muffler of the type initially described and essentially consists in that the shell of the truncated cone forms part of an absorbing filter known per se, is provided with holes and is surrounded by a sound-absorbing material, preferably steel wool, noting that a cylindrical sleeve is adjoining that end of the shell of the truncated cone having the smaller diameter and is forming part of the deflecting means. A silencer of such construction does not only allow a space-saving design providing a substantial advantage particularly for motor cycles but does also correspond to the requirements with respect to sound attenuation becoming still more severe in view of the steady progression in the construction of internal combustion engines of steadily increasing power and steadily increasing rotational speed. A further advantage of an inventive muffler resides in that this muffler provides optimal results also with respect to efficiency, so that the fuel comsumption can be reduced particularly for two-stroke internal combustion engines. Tests have shown that particularly favourable results with respect to sound attenuation and overall efficiency can be obtained if the ratio of the smaller diameter of the diffusor to its greater diameter is within the range of 1:2 to 1:3, particularly 1:2.3, if the ratio of the smaller diameter of the diffusor to the axial length of the diffusor is within the range of 1:8 to 1:12, preferably 1:10, if the ratio of the greater diameter of the absorbing filter to its small diameter is within the range of 1:0.25 to 1:0.4, preferably 1:0.33, and if the ratio of the greater diameter of the absorbing filter to its axial length is within the range of 1:2.7 to 1:3, preferably 1:2.85.

Further features of the invention and advantages resulting therefrom are set forth in the following description of embodiments shown in the drawing.

In the drawing

Figure 1:
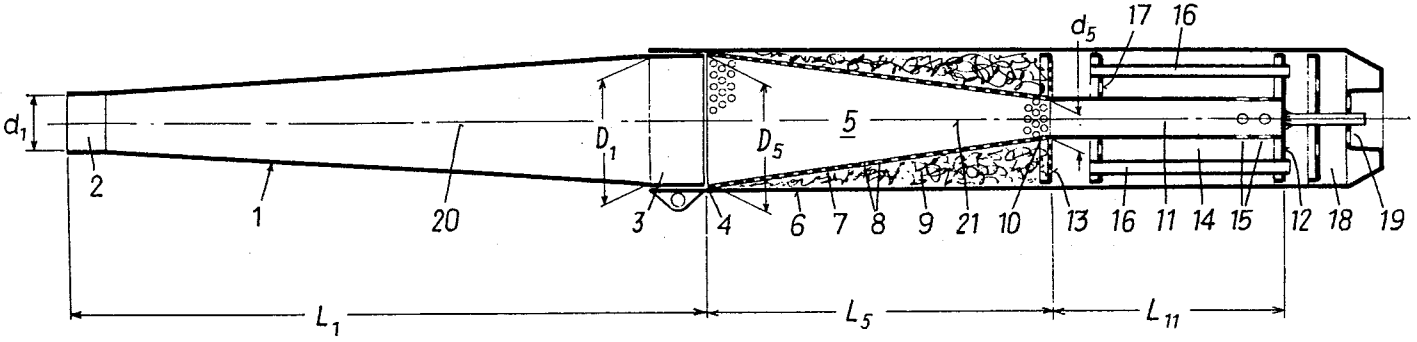
FIG. 1 shows a first embodiment.

The muffler according to the invention comprises at its inlet end a diffusor 1 having the shape of a conical tube and being connected to the exhaust gas conduit of an internal combustion engine with its end 2 having the smaller diameter. The diffusor 1 is with its end 3 having the greater diameter directly connected to the end 4 of greater diameter of the frustoconical absorbing filter 5 being surrounded by a muffler housing 6. The shell 7 of the truncated zone is provided with perforations 8 and surrounded by a sound-absorbing material 9, preferably steel wool, being arranged within the interior of the muffler housing 6. The end 10 of smaller diameter of the absorbing filter 5 is connected to one end of a tubular sleeve 11, the other end of which is closed by a front wall 12 extending to the muffler housing 6. The front wall 12 is, together with part of the muffler housing 6 and an intermediate wall 13, delimiting a chamber 14 surrounding the tubular sleeve 11. At that area of the tubular sleeve 11 which is located adjacent the front wall 12, i.e. approximately within the last third of this tubular sleeve, openings 15 are provided through which the exhaust gases can escape from the tubular sleeve 11 into the chamber 14. In view of the chamber 14 being closed by the front wall 12, the gases excaping through the openings 15 are deflected through an angle of 180° and are passed to that area of the chamber which is located adjacent the intermediate wall 13 and into which tubes 16, preferably four such tubes, are opening which extend in parallel relation to the tubular sleeve 11 and penetrate through the front wall 12. The ends of the tubes 16 which are remote from the front wall 12 are supported, for example, by a perforated intermediate wall 17.

The gases flowing in backward direction through the chamber 14 flow via tubes 16, which form a flow equalizer, into the chamber 18 and are from there exhausted to atmosphere via exhaust openings 19.

The intermediate wall 13 is preferably formed of perforated sheet metal. The tubular sleeve 11 can also have a varying diameter instead of a constant diameter.

The ratio of the diameter $d_1$ to the diameter $D_1$ of the diffusor 1 is approximately 1:2.3. The ratio of the diameter $d_1$ of the diffusor 1 to the axial length $L_1$ of the diffusor 1 is approximately 1:10. The ratio of the diameter $D_5$ of the absorbing filter 5 to the diameter $d_5$ of the absorbing filter 5 is approximately 1:0.33. The ratio of the diameter $D_5$ of the absorbing filter to the axial length $L_5$ of the absorbing filter is approximately 1:2.85. The axial length $L_{11}$ of the tubular sleeve 11 is approximately one half of the axial length $L_5$ of the absorbing filter 5. The ratio of the sum of the cross sections of the openings 15 to the cross section of the diffusor 1 at the area of its smallest diameter $d_1$ is approximately 0.2:1.

Figure 2:
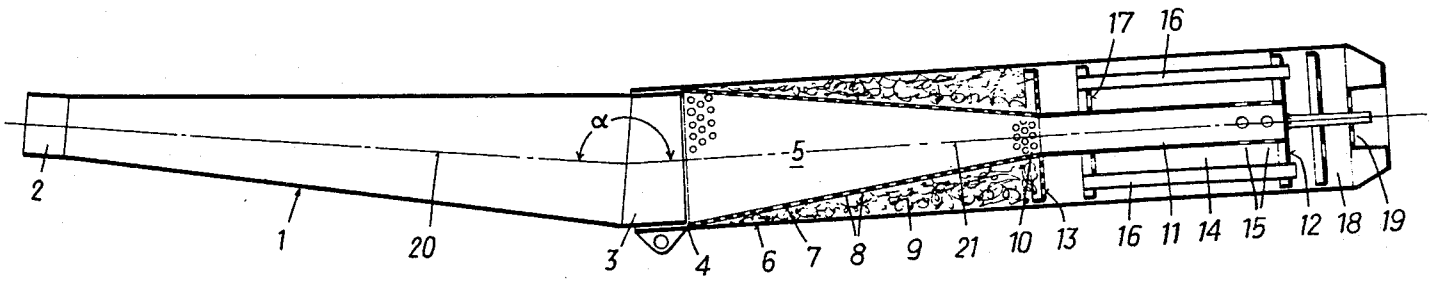
FIG. 2 shows a second embodiment, in section, of a muffler constructed according to the invention.

In the embodiment shown in FIG. 1, the axis 20 of the diffusor and the axis 21 of the absorbing filter form one single straight line. The embodiment according FIG. 2 differs from the embodiment according to FIG. 1 only in that the axis 20 of the diffusor is including with the axis 21 of the absorbing filter an angle $\alpha$ which is smaller than 180°. This provides a space-saving construction.

What is claimed is:

1. A muffler for use in conjunction with an internal combustion engine for reducing the noise level of exhaust gases emitted by the engine, the muffler comprising an elongated diffusor having the shape of a truncated cone, a smaller diameter defining an upstream end of the diffusor and a larger diameter defining a downstream end of the diffusor; a frustoconically shaped, perforated shell having an upstream, large diameter end coupled to the downstream end of the diffusor and a downstream, smaller diameter end, the shell including perforations; a generally cylindrical conduit having a first end attached to the downstream end of the shell, extending from the shell in a downstream direction, and including an opening adjacent a second end of the conduit; a housing surrounding the shell and the conduit and extending from the diffusor to a discharge end of the muffler; a sound absorbing material disposed between the shell and the housing; a baffle disposed within the housing to seal the opening and an annular space between the conduit and the housing from the discharge end and at least one tube oriented substantially parallel to the conduit, extending past the baffle and having a first, intake end proximate the first end of the conduit and a second, outlet end, communicating with the discharge end so that exhaust gas entering the diffusor can travel through the conduit tube, the opening therein, the annular space and thereafter through the tube to the discharge end of the muffler.

2. A muffler as claimed in claim 1, characterized in that the ratio between the smaller diameter of the diffusor and its larger diameter is in the range of 1:2 to 1:3.

3. A muffler according to claim 2 wherein said ratio is 1:2.3.

4. A muffler as claimed in claim 2, characterized in that the ratio between the smaller diameter of the diffusor and the axial length of the diffusor is in the range of 1:8 to 1:12.

5. A muffler as claimed in claim 4 wherein the last mentioned ratio is 1:10.

6. A muffler as claimed in claims 1, 2, 3 or 4, characterized in that the ratio between the larger diameter of the shell and its smaller diameter is in the range of 1:0.25 to 1:0.4.

7. A muffler as claimed in claim 6 wherein the last mentioned ratio is 1:0.33.

8. A muffler as claimed in claim 1, characterized in that the ratio between the larger diameter of the shell and its axial length is in the range of 1:2.7 to 1:3.

9. A muffler as claimed in claim 8, wherein the last mentioned ration is 1:2.85.

10. A muffler as claimed in claims 1, 2, 4 or 8, characterized in that the axial length of the conduit is approximately one half of the axial length of the shell.

11. A muffler as claimed in claim 10, characterized in that the second end of the conduit is closed, and wherein the opening of the conduit comprises a plurality of holes extending generally radially through the conduit and located in a portion of the conduit extending over about one third of its axial length from the second end of the conduit.

12. A muffler according to claim 11, wherein the baffle is defined by a plate extending transversely across the housing, the plate being positioned and arranged to close the second, downstream end of the conduit.

13. A muffler according to claim 12 including an intermediate plate spaced from the first mentioned plate and disposed proximate the first end of the conduit, and wherein the tube is supported by the plates.

14. A muffler according to claim 13 wherein the second tubes extend over a major portion of the length of the annular space, and wherein the intermediate plate includes perforations to permit the passage of exhaust gases from the radial openings in the first tube to an upstream end of the second tube.

15. A muffler according to claim 12 wherein the second tubes extend over a major portion of the length of the annular space.

16. A muffler as claimed in claim 11, characterized in that the ratio between the sum of the cross sections of the holes and the cross section of the diffusor at its smaller diameter is in the range of 0.15:1 and 0.25:1.

17. A muffler according to claim 16, wherein the last mentioned ratio is 0.2:1.

18. A muffler as claimed in claim 17, characterized in that the length of said tube is at least one third of the axial length of the diffusor.

19. A muffler as claimed in claim 1, characterized in that the axis of the diffusor is inclined relative to the axis of the shell by an angle of less than 180°.

* * * * *